US011490733B2

(12) United States Patent
Guo

(10) Patent No.: US 11,490,733 B2
(45) Date of Patent: Nov. 8, 2022

(54) UNDERFRAME WITH IMPROVED STRUCTURE

(71) Applicant: Zhongshan Meisihe Furniture Co., Ltd., Zhongshan (CN)

(72) Inventor: Liyi Guo, Guangzhou (CN)

(73) Assignee: Zhongshan Meisihe Furniture Co., Ltd., Zhongshan (CN)

( * ) Notice: Subject to any disclaimer, the term of this patent is extended or adjusted under 35 U.S.C. 154(b) by 0 days.

(21) Appl. No.: 17/381,856

(22) Filed: Jul. 21, 2021

(65) Prior Publication Data

US 2022/0022651 A1 Jan. 27, 2022

(30) Foreign Application Priority Data

Jul. 23, 2020 (CN) ..... 202010728267.8

(51) Int. Cl.
*A47C 1/024* (2006.01)
*A47C 1/025* (2006.01)
*A47C 3/30* (2006.01)

(52) U.S. Cl.
CPC ..... *A47C 1/0248* (2013.01); *A47C 1/025* (2013.01); *A47C 3/30* (2013.01)

(58) Field of Classification Search
CPC ..... A47C 1/0248; A47C 1/025; A47C 1/0244; A47C 3/30; A47C 1/026; A47C 7/465
See application file for complete search history.

(56) References Cited

U.S. PATENT DOCUMENTS 7,708,346 B2 * 5/2010 White ..... A47C 1/0244 297/362.12
10,278,504 B2 * 5/2019 Mezzera ..... A47C 1/03216
10,342,353 B2 * 7/2019 Chen ..... A47C 7/345

FOREIGN PATENT DOCUMENTS

CN 109393798 A * 3/2019 ..... A47C 1/024
CN 210337656 U * 4/2020
CN 212325923 U * 1/2021 ..... A47C 3/30

* cited by examiner

*Primary Examiner* — Milton Nelson, Jr.
(74) *Attorney, Agent, or Firm* — Tucker Ellis LLP; Heather M. Barnes

(57) ABSTRACT

Disclosed is an underframe with an improved structure. The underframe includes an underframe body, an operating handle, a reclining pull rope and a gas spring pull rope, a cushion back-and-forth moving mechanism being installed on the outer side of the underframe body, the operating handle being installed through a left outer wall of the underframe body at a lower end of the cushion back-and-forth moving mechanism, a backrest installed on a rear end of the underframe body through a backrest connecting rod; and a reclining elastic adjusting mechanism is arranged at a front end of an inner wall of the underframe body, a backrest angle adjusting mechanism is arranged at the inner wall of the underframe body on a right side of the reclining elastic adjusting mechanism, a cushion height adjusting mechanism is fixedly connected in the underframe body.

6 Claims, 3 Drawing Sheets

UNDERFRAME WITH IMPROVED STRUCTURE

CROSS-REFERENCE TO RELATED APPLICATION

This application is filed on the basis of Chinese patent application No. 202010728267.8 filed Jul. 23, 2020, and claims priority of the Chinese patent application, the entire contents of which are incorporated herein by reference.

TECHNICAL FIELD

The present disclosure relates to the technical field of chairs, and more particularly, to an underframe with an improved structure.

BACKGROUND

Chairs bring convenience to people's life as important facilities in offices and restaurants. Comfortable chairs have entered people's lives with increasingly improved modern living condition. In order to meet people's needs, different types of adjustable chairs are available in the market, such as folding chairs, swivel lift chairs and backrest chairs with adjustable inclination angle. An existing chair may have handles on both sides to independently control lifting of the chair, back-and-forth swinging of the back and headrest, and back-and-forth sliding of the cushion. These handles are cumbersome and troublesome in operation, and bring inconvenience to people. In addition, three pull ropes are used to control the above three functions. Such an underframe has the disadvantages of complex mechanism, inconvenient operation, large size and compromised aesthetics, therefore, an underframe with an improved structure is urgently needed to solve the above problems.

SUMMARY

The purpose of the present disclosure is to provide an underframe with an improved structure to solve the problems of troublesome operation, complex internal structure, inconvenient use, large size and compromised aesthetics caused by too many handles in the above background art.

In order to achieve the above purpose, the technical scheme of the present disclosure is to provide an underframe with an improved structure, which includes an underframe body, an operating handle, a reclining pull rope and a gas spring pull rope; a cushion back-and-forth moving mechanism is installed on the outer side of the underframe body, the operating handle penetrates through and is installed on the left outer wall of the underframe body at the lower end of the cushion back-and-forth moving mechanism, a backrest is installed on the rear end of the underframe body through a backrest connecting rod, a reclining elastic adjusting mechanism is arranged at the front end of the inner wall of the underframe body, a backrest angle adjusting mechanism is arranged at the inner wall of the underframe body on the right side of the reclining elastic adjusting mechanism, a cushion height adjusting mechanism is fixedly connected in the underframe body, a handle is arranged at the left end of the operating handle, a handle connecting block is arranged at the right end of the handle through a bolt, a slider locking control lever is fixedly connected at the middle part of the top end of the handle connecting block, a handle base is fixedly connected at the right end of the handle connecting block, one end of the handle base is provided with a reclining rope groove, the bottom end of the handle is provided with a gas spring pull rope groove, one end of the reclining pull rope is fixedly connected in the backrest angle adjusting mechanism through a groove, the other end thereof away from the backrest angle adjusting mechanism is fixedly connected to the right end of the operating handle, one end of the gas spring pull rope is fixedly at the cushion height adjusting mechanism through a gas spring pull rope groove, the other end thereof away from the cushion height adjusting mechanism is fixedly connected at the bottom end of the operating handle, and the right end of the handle is connected with the cushion height adjusting mechanism through the slider locking control lever.

In some embodiments, the left end of the reclining pull rope is connected to the handle connecting block, and the other end thereof passes through the reclining positioning block; one end of the gas spring pull rope is fixedly connected in a groove at the bottom of the handle, and the other end thereof is fixedly connected in a groove of the gas spring throw rod via a pull rope fixing block.

In some embodiments, the gas spring pull rope is interspersed into the reclining locking control spring through the pull rope fixing block, one end of the reclining locking control spring is welded on the outer wall of the rear end of the pull rope fixing block, the other end thereof away from the pull rope fixing block is welded on the outer wall of the front end of the reclining positioning block, a reclining locking spring is welded on the outer wall of the rear end of the reclining positioning block, one end of the reclining locking spring away from the reclining positioning block is welded on the outer wall of the front end of the reclining locking teeth, a reclining rotating screw and a reclining positioning screw penetrate through the rear end of the reclining locking teeth with equal distance to top and bottom, and the bottom end of the reclining rotating screw is fixedly connected to a gas spring throw rod.

In some embodiments, a reclining elasticity adjustment male gear is installed at the right side of the elasticity adjustment knob, the right end of the reclining elasticity adjustment male gear is clamped on the outer wall of a reclining elasticity adjustment female gear, the rear end of the reclining elasticity adjustment female gear penetrates through and connects a reclining spring front base, a reclining spring is welded on the left outer wall of the reclining spring front base, and one end of the reclining spring away from the reclining spring front base is welded on the right outer wall of the reclining spring rear base.

In some embodiments, the cushion back-and-forth moving mechanism is internally provided with a slider fixing frame, the front and rear ends of the slider fixing frame are fixedly connected to slider bearings, the outer wall of the slider bracket is fixed to the slider bearings through slider bracket fixing screws and inserted into the inner wall of the slider fixing frame, a small cover for fixing slider positioning teeth is fixedly connected to the middle of the cushion back-and-forth moving mechanism and internally provided with slider positioning teeth, a slider spring is welded on the right side of the slider positioning teeth, and the other end of the slider spring is chaired on the inner wall of the cushion back-and-forth moving mechanism.

In some embodiments, the left side of the reclining elasticity adjustment male gear is connected with the elasticity adjustment knob, and the outer wall of the elasticity adjustment knob is provided with skidproof stripes.

Compared with the existing technology, the present disclosure has the following beneficial effects: the structurally improved multifunctional underframe is provided with an operating handle, a reclining pull rope, a gas spring pull rope, a reclining elastic adjusting mechanism, a backrest angle adjusting mechanism, a cushion height adjusting mechanism and a cushion back-and-forth moving mechanism. The cushion back-and-forth moving mechanism, the cushion height adjusting mechanism and the backrest angle adjusting mechanism are controlled by two pull ropes; so a user can adjust the angle of the backrest, the lifting and back-and-forth movement of the cushion by pulling the operating handle in different directions, thereby simplifying the structure of the chair, catering for the user's operating habits, giving the user more convenient and reasonable using experience, allowing the user to sit on and directly adjust the chair, and enhancing the practicability of the chair.

DETAILED DESCRIPTION

The technical scheme in the embodiments of the present disclosure will be described clearly and completely as follows in combination with the drawings. Apparently, the embodiments described are only some embodiments of the present disclosure, but not all embodiments. Based on the embodiments of the present disclosure, all other embodiments obtained by those of ordinary skill in the art without creative work fall within the protection scope of the present disclosure.

Figure 1:
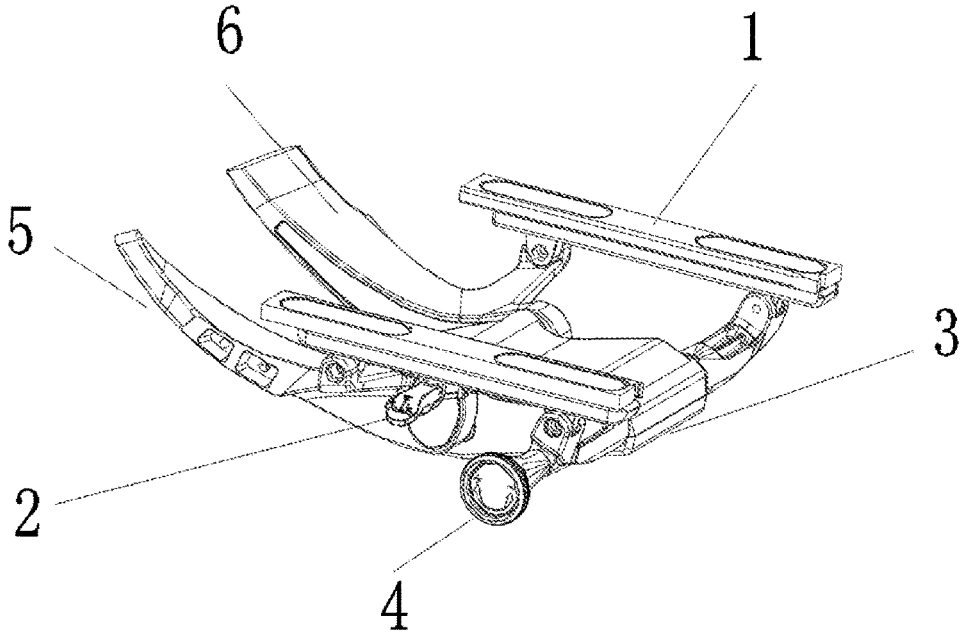
FIG. 1 is an overall structural schematic diagram of an embodiment of the present disclosure.
Figure 2:
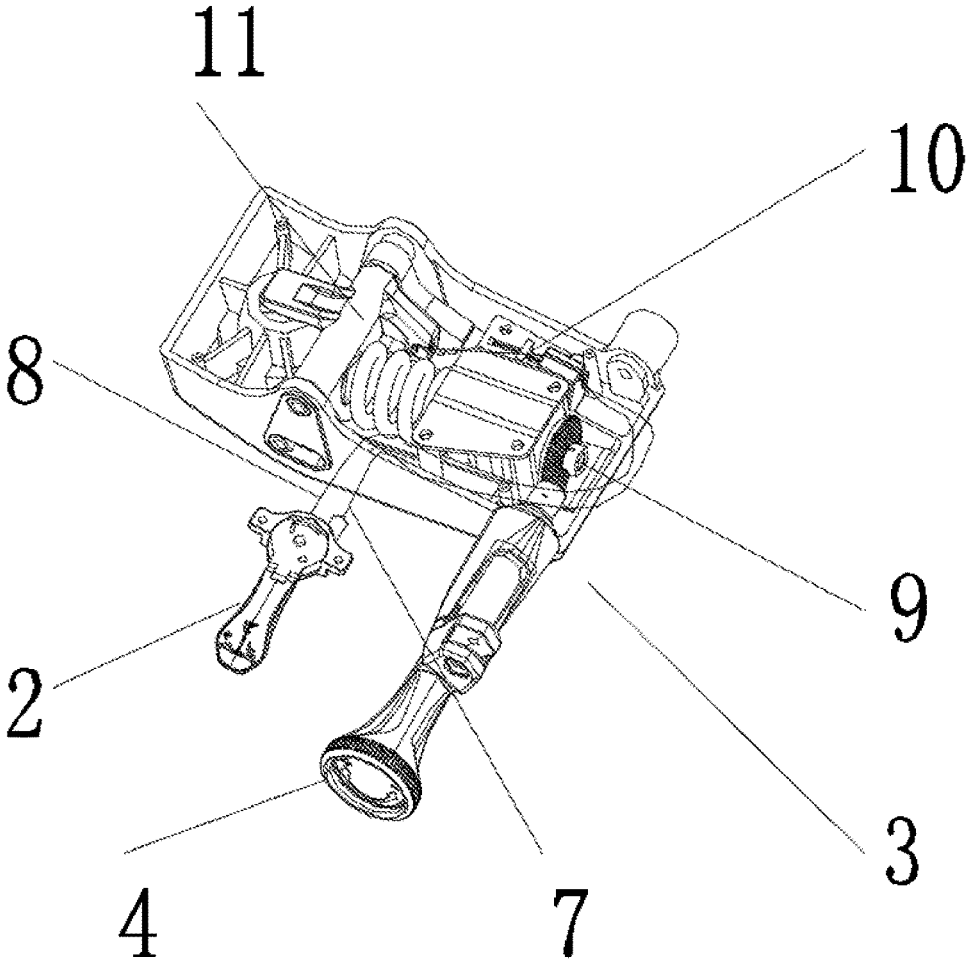
FIG. 2 is an internal structural schematic diagram of an embodiment of the present disclosure.
Figure 3:
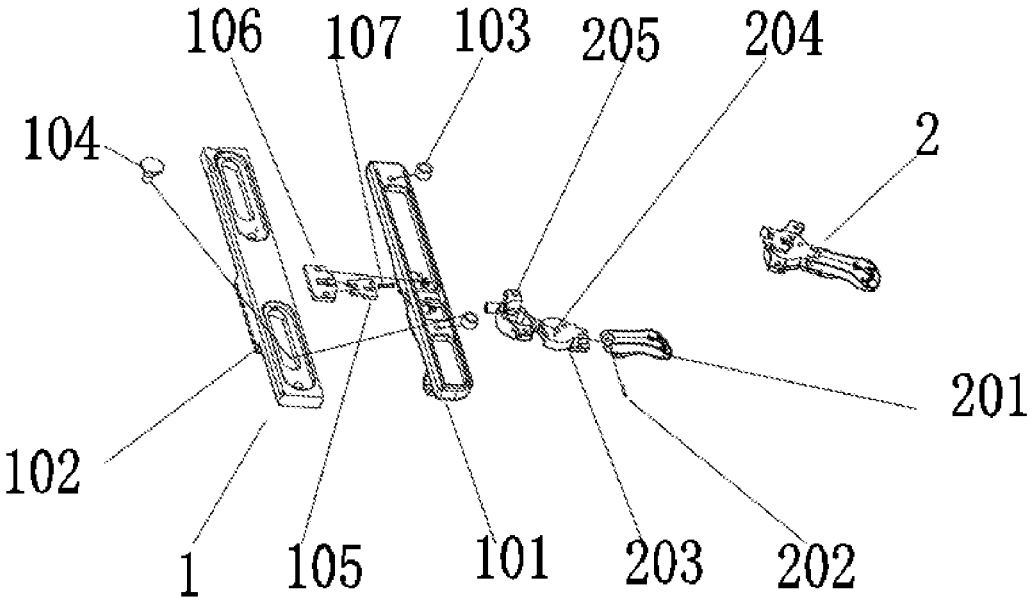
FIG. 3 is a structural schematic diagram of slider of an embodiment of the present disclosure.
Figure 4:
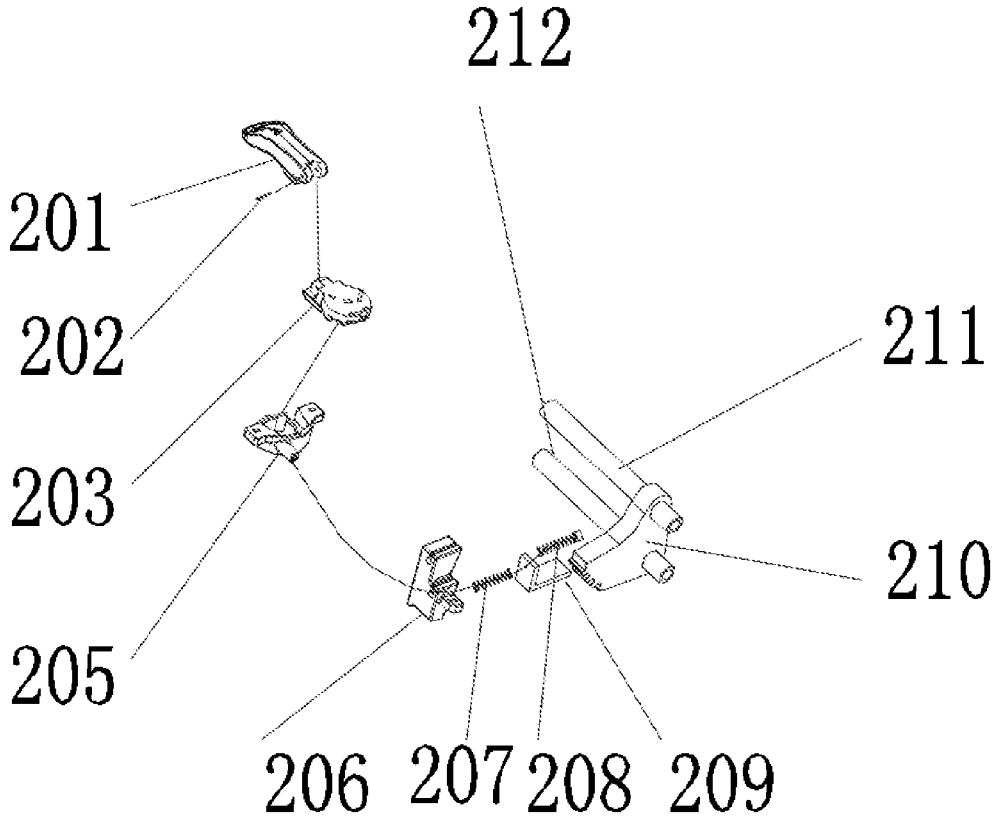
FIG. 4 is a reclining schematic diagram of an embodiment of the present disclosure.
Figure 5:
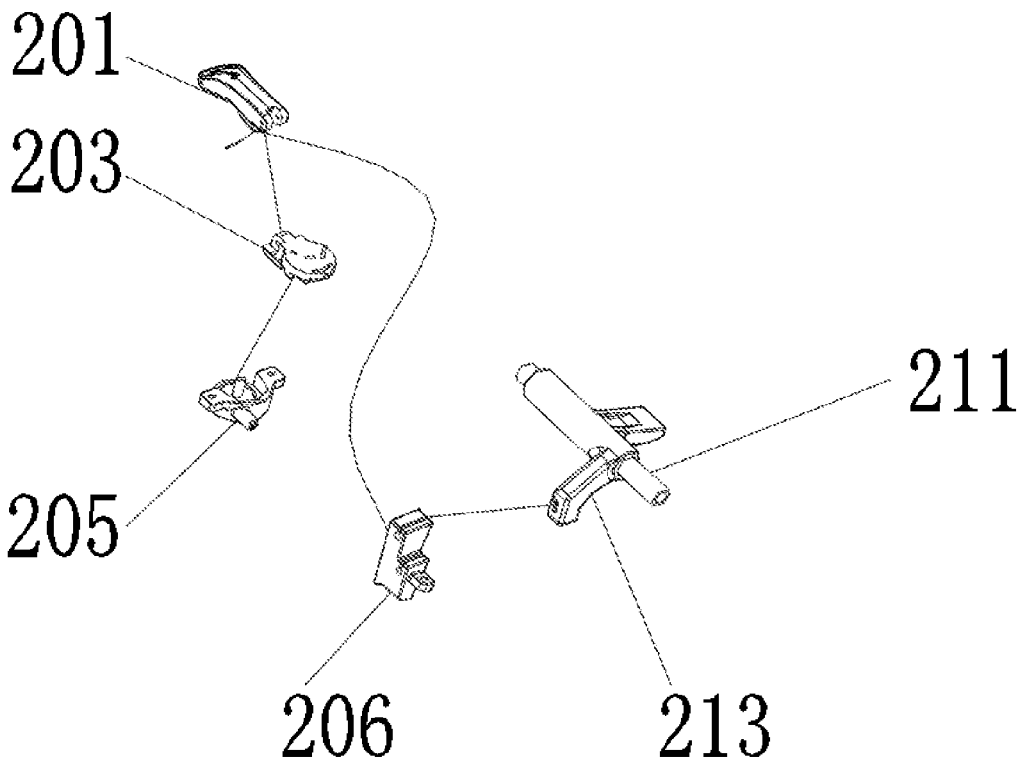
FIG. 5 is a structural schematic diagram of a gas spring of an embodiment of the present disclosure.
Figure 6:
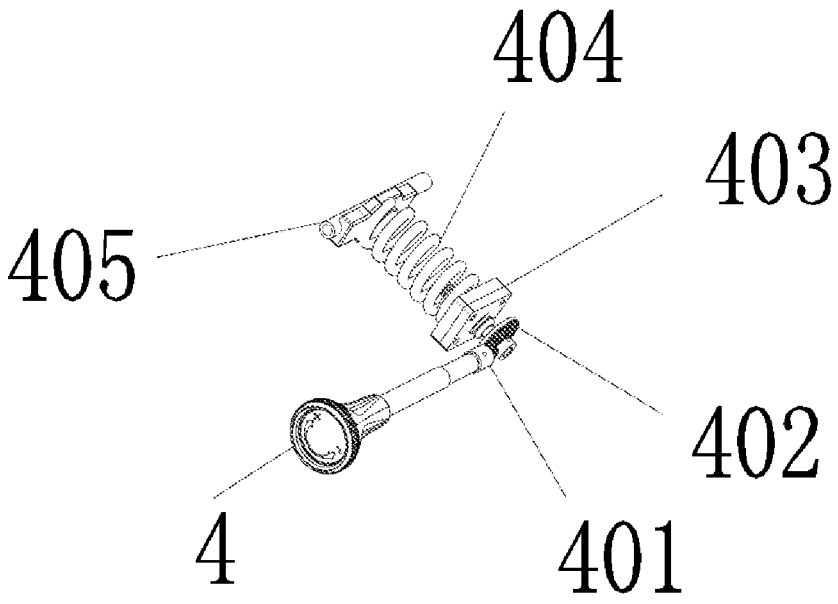
FIG. 6 is a schematic diagram of an elastic structure of an embodiment of the present disclosure.

Referring to FIG. 1 to FIG. 6, an underframe with an improved structure of the present disclosure comprises an underframe body 3, an operating handle 2, a reclining pull rope 7 and a gas spring pull rope 8; a cushion back-and-forth moving mechanism 1 is installed on the outer side of the underframe body 3, the operating handle 2 penetrates through and is installed on the left outer wall of the underframe body 3 at the lower end of the cushion back-and-forth moving mechanism 1, a backrest 6 is installed on the rear end of the underframe body 3 through a backrest connecting rod 5, a reclining elastic adjusting mechanism 9 is arranged at the front end of the inner wall of the underframe body 3, a backrest angle adjusting mechanism 10 is arranged at the inner wall of the underframe body 3 on the right side of the reclining elastic adjusting mechanism 9, a cushion height adjusting mechanism 11 is fixedly connected in the underframe body 3, a handle 201 is arranged at the left end of the operating handle 2, a handle connecting block 203 is arranged at the right end of the handle 201 through a bolt 202, a slider locking control lever 204 is fixedly connected at the middle part of the top end of the handle connecting block 203, a handle base 205 is fixedly connected at the right end of the handle connecting block 203, one end of the handle base 205 is provided with a reclining rope groove, the bottom end of the handle 201 is provided with a gas spring pull rope groove, one end of the reclining pull rope 7 is fixedly connected in the backrest angle adjusting mechanism 10 through a groove, the other end thereof away from the backrest angle adjusting mechanism 10 is fixedly connected to the right end of the operating handle 2, one end of the gas spring pull rope 8 is fixedly at the cushion height adjusting mechanism 11 through a gas spring pull rope groove, the other end thereof away from the cushion height adjusting mechanism 11 is fixedly connected at the bottom end of the operating handle 2, and the right end of the handle 201 is connected with the cushion height adjusting mechanism 11 through a slider locking control lever 204, so as to pull the underframe body with two pull ropes, which increases the convenience of the underframe compared with those with three ropes in the market.

The left end of the reclining pull rope 7 is connected to the handle connecting block 203, and the other end thereof passes through the reclining positioning block 209; one end of the gas spring pull rope 8 is fixedly connected in a groove at the bottom of the handle 201, and the other end thereof is fixedly connected in a groove of the gas spring throw rod 213 via a pull rope fixing block 206, so as to fix the pull ropes and thereby increasing the stability of the underframe.

The gas spring pull rope 8 is interspersed into the reclining locking control spring 207 through the pull rope fixing block 206, one end of the reclining locking control spring 207 is welded on the outer wall of the rear end of the pull rope fixing block 206, the other end thereof away from the pull rope fixing block 206 is welded on the outer wall of the front end of the reclining positioning block 209, a reclining locking spring 208 is welded on the outer wall of the rear end of the reclining positioning block 209, one end of the reclining locking spring 208 away from the reclining positioning block 209 is welded on the outer wall of the front end of the reclining locking teeth 210, a reclining rotating screw 211 and a reclining positioning screw 212 penetrate through the rear end of the reclining locking teeth 210 with equal distance to top and bottom, and the bottom end of the reclining rotating screw 211 is fixedly connected to a gas spring throw rod 213, so as to adjust the reclining mechanism and thereby increasing the integrity of the underframe.

A reclining elasticity adjustment male gear 401 is installed at the right side of the elasticity adjustment knob 4, the right end of the reclining elasticity adjustment male gear 401 is clamped on the outer wall of a reclining elasticity adjustment female gear 402, the rear end of the reclining elasticity adjustment female gear 402 penetrates through and connects a reclining spring front base 403, a reclining spring 404 is welded on the left outer wall of the reclining spring front base 403, and one end of the reclining spring 404 away from the reclining spring front base 403 is welded on the right outer wall of the reclining spring rear base 405, so as to increase elastic force and thereby enhancing the practicability of the underframe.

The cushion back-and-forth moving mechanism 1 is internally provided with a slider fixing frame 101, the front and rear ends of the slider fixing frame 101 are fixedly connected to slider bearings 103, the outer wall of the slider bracket 102 is fixed to the slider bearings 103 through slider bracket fixing screws 104 and inserted into the inner wall of the slider fixing frame 101, a small cover for fixing slider positioning teeth 106 is fixedly connected to the middle of the cushion back-and-forth moving mechanism 1 and internally provided with slider positioning teeth 105, a slider spring 107 is welded on the right side of the slider positioning teeth 105, and the other end of the slider spring 107 is chaired on the inner wall of the cushion back-and-forth moving mechanism 1, so as to slide the chairs back and forth and thereby enhancing the integrity of the underframe.

The left side of the reclining elasticity adjustment male gear 401 is connected with the elasticity adjustment knob 4, and the outer wall of the elasticity adjustment knob 4 is provided with skidproof stripes, so as to rotate the elasticity adjustment knob 4 conveniently, enhance the friction between the palm and the elasticity adjustment knob 4, and thereby making the underframe more practical.

Operating Principle:

Description of the backrest reclining angle adjusting mechanism: one end of the reclining pull rope 7 is fixed on the handle connecting block 203, and the other end thereof is connected to the inside the backrest angle adjusting mechanism 10 through the reclining positioning block 209. Convex points and grooves are correspondingly arranged at the right end of the handle 201 at the left end of the operating handle 2 and inside the handle base 205. When the handle 201 is pulled backward to the groove and released, the handle connecting block 203 will be fixed in a position through the positioning point. The reclining pull rope 7 pulls the reclining locking spring 208 under the action of the handle connecting block 203, and the reclining positioning block 209 moves forward under the action of the reclining locking spring 208. Then, the reclining positioning block 209 is disengaged from the reclining locking teeth 210, and the angle of the backrest 6 allows the reclining positioning screw 212 to move freely back and forth with the reclining rotating screw 211 as the central axis under the action of the backrest connecting rod 5. When the handle 201 is pulled forward to the middle groove and released, the handle connecting block 203 will be fixed at the middle positioning point. As a result, the reclining pull rope 7 will be free from the stretching force of the handle 201, and the reclining positioning block 209 will be re-engaged with the reclining locking teeth 210 under the action of the reclining locking control spring 207 to fix the inclination angle of the backrest 6.

Description of cushion height adjusting mechanism: one end of the gas spring pull rope 8 is fixed on the groove of the bottom of the handle 201, and the other end thereof is fixed on the groove of the gas spring throw rod 213 through the pull rope fixing block 206. When the handle 201 is pulled upward to drive the gas spring throw rod 213 through the gas spring pull rope 8, the pressure block in the middle of the gas spring throw rod 213 will press the head of gas spring to achieve the purpose of lifting the chair. Now, the handle 201 can be released, and the pressure block in the middle of the gas spring throw rod 213 is disengaged from the head of gas spring, so that the gas spring is fixed at a certain specified height, thereby achieving the purpose of lifting the chair.

Function description of cushion back-and-forth moving mechanism 1: the cushion is fixed inside the slider fixing frame 101 through the slider bracket 102, and the slider bracket 102 and the slider fixing frame 101 are fixed on the slider bearing 103 through the slider bracket fixing screw 104. When the handle 201 is pulled forward to the front groove and released, the handle connecting block 203 will be fixed at a limited position through a positioning point. Then, the slider positioning teeth 105 is disengaged from the teeth position of the slider bracket 102 driven by the slider locking control lever 204, thus achieving the ability of moving back and forth. When the handle 201 is pulled backward to the middle groove and released, the handle connecting block 203 will be fixed on a positioning point. Then, the small cover for fixing slider positioning teeth 106 will be free from the acting force of the slider locking control lever 204, and the slider positioning teeth 105 will be re-engaged with the teeth positions on the slider bracket 102 under the elastic force of the slider spring 107 to achieve the locking effect.

Function description of reclining elasticity adjustment of backrest: the strength of the backrest 6 is controlled by the elasticity of the reclining spring 404, combined with the acting force of the reclining spring rear base 405 and the reclining positioning screw 212. When the elasticity adjustment knob 4 is twisted clockwise to rotate the reclining elasticity adjustment male gear 401, the reclining elasticity adjustment male gear 401 will be engaged with the reclining elasticity adjustment female gear 402 and drive the reclining spring front base 403 to move backward, thereby making the spring compress and increasing the reclining effect, or otherwise, reducing the reclining effect.

It is apparent to those skilled in the art that the present disclosure is not limited to the details of the above exemplary embodiments, and can be implemented in other specific forms without departing from the spirit or basic features of the present disclosure. Therefore, the embodiments should be regarded as exemplary and non-limiting in every respect. The scope of the present disclosure is defined by the appended claims rather than the above description, and thus all changes that fall within the meaning and range of equivalent elements of the claims are intended to be included in the present disclosure. Any reference signs in the claims shall not be regarded as limiting the claims involved.

What is claimed is:

1. An underframe with an improved structure, comprising an underframe body, an operating handle, a reclining pull rope and a gas spring pull rope, a cushion back-and-forth moving mechanism being installed on the outer side of the underframe body, the operating handle being installed through a left outer wall of the underframe body at a lower end of the cushion back-and-forth moving mechanism, a backrest installed on a rear end of the underframe body through a backrest connecting rod; and wherein a reclining elastic adjusting mechanism is arranged at a front end of an inner wall of the underframe body, a backrest angle adjusting mechanism is arranged at the inner wall of the underframe body on a right side of the reclining elastic adjusting mechanism, a cushion height adjusting mechanism is fixedly connected in the underframe body, a handle is arranged at a left end of the operating handle, a handle connecting block is arranged at a right end of the handle through a bolt, a slider locking control lever is fixedly connected at a middle part of a top end of the handle connecting block, a handle base is fixedly connected at a right end of the handle connecting block, a reclining rope groove is provided at one end of the handle base, a bottom end of the handle is provided with a gas spring pull rope groove, one end of the reclining pull rope is fixedly connected in the backrest angle adjusting mechanism through a groove, the other end thereof away from the backrest angle adjusting mechanism is fixed at a right end of the operating handle, one end of the gas spring pull rope is fixedly connected in the cushion height adjusting mechanism through a gas spring pull rope groove, the other end thereof away from the cushion height adjusting mechanism is fixedly connected at a lower end of the operating handle, and the right end of the handle is connected with the cushion height adjusting mechanism through the slider locking control lever.

2. The underframe of claim 1, wherein one end of the reclining pull rope is connected to the handle connecting block, and the other end thereof passes through a reclining positioning block; one end of the gas spring pull rope is fixedly connected in a groove at the bottom of the handle, and the other end thereof is fixedly connected in a groove of a gas spring throw rod via a pull rope fixing block.

3. The underframe of claim 2, wherein the gas spring pull rope is interspersed into a reclining locking control spring through the pull rope fixing block, one end of the reclining locking control spring is welded on the outer wall of the rear end of the pull rope fixing block, the other end thereof away from the pull rope fixing block is welded on an outer wall of a front end of the reclining positioning block, a reclining locking spring is welded on the outer wall of the rear end of the reclining positioning block, one end of the reclining locking spring away from the reclining positioning block is welded on an outer wall of a front end of reclining locking teeth, a reclining rotating screw and a reclining positioning screw penetrate through the rear end of the reclining locking teeth with equal distance to top and bottom, and the bottom end of the reclining rotating screw is fixedly connected to the gas spring throw rod.

4. The underframe of claim 1, wherein the cushion back-and-forth moving mechanism further comprises a slider bracket, the cushion back-and-forth moving mechanism is internally provided with a slider fixing frame, the front and rear ends of the slider fixing frame are fixedly connected to slider bearings, an outer wall of the slider bracket is fixed to the slider bearings through slider bracket fixing screws and inserted into an inner wall of the slider fixing frame, a small cover for fixing slider positioning teeth is fixedly connected to a middle of the cushion back-and-forth moving mechanism and internally provided with slider positioning teeth, a slider spring is welded on a rear side of the slider positioning teeth, and the other end of the slider spring is welded on an inner wall of the cushion back-and-forth moving mechanism.

5. The underframe of claim 1, further comprising an elasticity adjustment knob, wherein a reclining elasticity adjustment male gear is installed at a right side of the elasticity adjustment knob, a right end of the reclining elasticity adjustment male gear is clamped on an outer wall of a reclining elasticity adjustment female gear, a rear end of the reclining elasticity adjustment female gear penetrates through and connects a reclining spring front base, a reclining spring is welded on a left outer wall of the reclining spring front base, and one end of the reclining spring away from the reclining spring front base is welded on a right outer wall of a reclining spring rear base.

6. The underframe of claim 5, wherein a left side of the reclining elasticity adjustment male gear is connected with the elasticity adjustment knob, and a side profile of the elasticity adjustment knob is circular.

* * * * *